US011690394B2

(12) United States Patent
Liu et al.

(10) Patent No.: US 11,690,394 B2
(45) Date of Patent: Jul. 4, 2023

(54) DEVICE AND METHOD FOR SEPARATING LIGHT FLAKY CUT ROLLED STEMS (CRSS) BY THROWING ROLLER

(71) Applicant: CHINA TOBACCO YUNNAN INDUSTRIAL CO., LTD, Kunming (CN)

(72) Inventors: Ze Liu, Kunming (CN); Banghua He, Kunming (CN); Lin Qi, Kunming (CN); Changgui Qiu, Kunming (CN); Yongzheng Li, Kunming (CN); Yong Zhu, Kunming (CN); Yuanzhen Zhou, Kunming (CN); Xishu Tang, Kunming (CN); Jun Tang, Kunming (CN); Gang Huang, Kunming (CN); Bing Zhou, Kunming (CN); Yunyue Cui, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 17/775,594

(22) PCT Filed: Oct. 14, 2020

(86) PCT No.: PCT/CN2020/120931
§ 371 (c)(1),
(2) Date: May 10, 2022

(87) PCT Pub. No.: WO2022/073251
PCT Pub. Date: Apr. 14, 2022

(65) Prior Publication Data

US 2022/0386679 A1 Dec. 8, 2022

(30) Foreign Application Priority Data

Oct. 10, 2020 (CN) ..... 202011078569.1

(51) Int. Cl.
*B07B 4/02* (2006.01)
*A24C 5/39* (2006.01)
(Continued)

(52) U.S. Cl.
CPC ..... *A24B 5/16* (2013.01); *A24B 5/04* (2013.01); *A24C 5/396* (2013.01); *B07B 4/00* (2013.01);
(Continued)

(58) Field of Classification Search
CPC ..... A24B 5/16; A24B 5/04; B07B 4/0025; B07B 7/04
(Continued)

(56) References Cited

U.S. PATENT DOCUMENTS 2,230,195 A 1/1941 Foundry
2,941,667 A * 6/1960 Hilgartner, Jr. ..... A24B 5/10 209/134
(Continued)

FOREIGN PATENT DOCUMENTS

CN 206286194 U 6/2017
CN 206880049 U 1/2018
(Continued)

OTHER PUBLICATIONS

Dingkun, Ding, "Spiral Type Leaf Throwing Roller for Wind Separating Warehouse" (English Translation), Mar. 5, 2019, worldwide.espacenet.com (Year: 2019).*

*Primary Examiner* — Michael McCullough
*Assistant Examiner* — Molly K Devine
(74) *Attorney, Agent, or Firm* — Bayramoglu Law Offices LLC

(57) ABSTRACT

A device for separating light flaky cut rolled stems (CRSs) by a throwing roller is provided. The device includes a vertically provided separation bin, and a CRS guide device
(Continued)

and a CRS distribution plate which are arranged in the separation bin. The present disclosure further provides a method for separating light flaky CRSs by using the device. The present disclosure achieves full separation of finished CRSs from light flaky CRSs. The device of the present disclosure is designed for the first time, and can be directly connected to a pneumatic CRS feeding and discharging section of a production line. The device of the present disclosure is compact and suitable for industrial production.

18 Claims, 2 Drawing Sheets

(51) Int. Cl.

| | |
|---|---|
| ***A24B 5/16*** | (2006.01) |
| ***A24B 5/04*** | (2006.01) |
| ***B07B 7/01*** | (2006.01) |
| ***B07B 11/02*** | (2006.01) |
| ***B07B 11/06*** | (2006.01) |
| ***B07B 4/00*** | (2006.01) |
| ***B07B 11/04*** | (2006.01) |

(52) U.S. Cl.
CPC ..... *B07B 7/01* (2013.01); *B07B 11/02* (2013.01); *B07B 11/04* (2013.01); *B07B 11/06* (2013.01)

(58) Field of Classification Search
USPC ..... 209/136, 138; 131/109.2, 110
See application file for complete search history.

(56) References Cited

U.S. PATENT DOCUMENTS

| | | | | | |
|---|---|---|---|---|---|
| 3,360,125 | A * | 12/1967 | Horsey | A24B 5/10 | 209/31 |
| 3,593,851 | A * | 7/1971 | Davidson | A24B 5/10 | 209/139.1 |
| 3,655,043 | A * | 4/1972 | Wochnowski | B07B 4/025 | 209/149 |
| 4,214,595 | A * | 7/1980 | Labbe | A24C 5/39 | 131/109.2 |
| 2004/0055612 | A1 * | 3/2004 | Kubo | A24C 5/1871 | 131/84.3 |

FOREIGN PATENT DOCUMENTS

| | | | | | |
|---|---|---|---|---|---|
| CN | 109420616 | A * | 3/2019 | B07B 11/02 | |
| CN | 208574936 | U | 3/2019 | | |
| CN | 110074448 | A | 8/2019 | | |
| CN | 110548679 | A | 12/2019 | | |
| CN | 112369655 | A | 2/2021 | | |
| EP | 1447015 | A1 * | 8/2004 | A24C 5/396 | |
| WO | WO-2015194949 | A1 * | 12/2015 | B07B 4/025 | |

* cited by examiner

DEVICE AND METHOD FOR SEPARATING LIGHT FLAKY CUT ROLLED STEMS (CRSS) BY THROWING ROLLER

CROSS REFERENCE TO THE RELATED APPLICATIONS

This application is the national phase entry of International Application No. PCT/CN2020/120931, filed on Oct. 14, 2020, which is based upon and claims priority to Chinese Patent Application No. 202011078569.1, filed on Oct. 10, 2020, the entire contents of which are incorporated herein by reference.

TECHNICAL FIELD

The present disclosure belongs to the technical field of tobacco processing, and in particular relates to a device and method for separating light flaky cut rolled stems (CRSs) on line by a throwing roller.

BACKGROUND

As a main component of tobacco formulations, CRSs are used in large quantities by cigarette processing enterprises due to their high filling value, low cost, and high flammability. At present, the CRSs used account for 5.0-20.0 wt % of the cut tobacco, which effectively reduces the cost of cigarette formulations and adjusts the quality of cigarettes.

In recent years, with the in-depth research on CRS preparation techniques such as "thin-roll and thin-cut" and "hot-roll and cold-cut", the appearance quality of CRSs has been significantly improved. Specifically, the blending uniformity between the CRSs and cut laminas and the stability of the physical quality of cigarettes have been significantly improved. However, the "thin-roll and thin-cut" process has a problem of decreased uniformity of CRSs. Too thin CRSs are expanded and dried to become white, light-transmitting flakes with low density, which are referred to as light flaky CRSs. The light flaky CRSs are easy to break and not enduring during subsequent processing, resulting in a decrease in the blending uniformity between the CRSs and cut laminas. Due to the low density, the light flaky CRSs are mostly distributed on both sides of the blending belt after blending, which leads to a large fluctuation in the physical quality of the finished cut tobacco. In addition, problems such as high breakage rate, low processing endurance, unstable moisture content of the cut tobacco, and other quality control difficulties in the pneumatic rolling process exist.

Statistics of 10 lots of cut tobacco in actual production show that light flaky CRSs account for 15-25 wt % of normal CRSs. During subsequent processing, most of the light flaky CRSs are converted into ash to be removed, which increases the de-dusting load of the cigarette maker and affects the quality of the finished cigarettes. Therefore, the light flaky CRSs must be removed.

In order to solve the above problems, the present disclosure devises a device for separating light flaky CRSs by a throwing roller and a method for separating light flaky CRSs by the device.

SUMMARY

The present disclosure provides a device for separating light flaky CRSs on line by a throwing roller, which is designed for the first time. By separating the light flaky CRSs, the device obtains finished CRSs featuring a high whole cut rate, a high filling value, strong processing endurance, a desired color close to that of cut laminas, and a desired blending effect.

The objective of the present disclosure is achieved by the following technical solutions.

A device for separating light flaky CRSs by a throwing roller includes: a vertically provided separation bin T and a CRS guide device 1 and a CRS distribution plate 2 which are arranged in the separation bin T, where the CRS guide device 1 includes a guide plate 11 and a throwing roller 12; the guide plate 11 is in the shape of a triangular prism, with a rectangular surface attached to a surface of the throwing roller 12 and a rectangular surface formed as a guide surface 112; and the CRS distribution plate 2 is arc-shaped, and evenly provided with multiple air vents 21; and a CRS feed port T1 is provided above the CRS guide device 1; the guide plate 11 is provided on an upper portion of a side of the throwing roller 12, such that the guide surface 112 guides CRSs fed through the feed port T1 to the surface of the throwing roller 12; a suction port T2 is provided above the CRS distribution plate 2, and is connected to an external suction fan T22; and the CRS distribution plate 2 is provided under a side of the CRS guide device 1, with a concave arc surface facing the CRS guide device 1.

Preferably, the rectangular surface of the guide plate 11 attached to the surface of the throwing roller 12 may be formed as a concave arc surface 111, which may be adapted to the surface of the throwing roller 12; the guide surface 112 may have an upper end provided under the feed port T1 and a lower end provided on the surface of the throwing roller 12; and a final rectangular surface of the guide plate 11 may have an area the same as or different from the rectangular surface of the guide plate 11 that may be formed as the guide surface 112.

Preferably, the surface of the throwing roller 12 may be axially evenly provided with multiple homogenizing baffles 121; and the homogenizing baffles 121 on the surface of the throwing roller 12 may be parallel with each other and each may be bent at a midpoint, forming a swallow-wing pattern with a tip 1211 facing forward on the surface of the throwing roller 12, where the "facing forward" indicates a rotation direction of the throwing roller.

Preferably, the CRS distribution plate 2 may have an open area of 5.0-20.0%.

Preferably, a bottom portion of the separation bin T may be provided with a guide plate 3; a discharge port T3 may be provided at a bottom of the guide plate 3; and the discharge port T3 may be also located under the CRS distribution plate 2.

Preferably, an angle of the guide surface 112 relative to a horizontal plane may be adjustable, and the throwing roller 12 may have an adjustable rotation speed.

Preferably, an angle of a tangent plane of a convex arc surface of the CRS distribution plate 2 relative to a horizontal plane may be adjustable.

Preferably, the suction fan T22 may have an adjustable suction speed.

Preferably, the separation bin T may be in the shape of a rectangular parallelepiped.

A second aspect of the present disclosure provides a method for separating light flaky CRSs, using the above-mentioned device, and including the following steps: turning on the suction fan T22, and adjusting the suction speed of the suction fan; allowing CRSs fed through the feed port T1 to slide down the guide surface 112 and rest between the homogenizing baffles 121 of the throwing roller 12; rotating the throwing roller 12 with the tip 1211 facing forward, such that the CRSs between the homogenizing baffles 121 are dispersed axially, and are thrown into the concave arc surface of the CRS distribution plate 2; forming a negative pressure in the separation bin T by the suction fan T22, such that the air flows from under the CRS distribution plate 2 through the evenly distributed air vents 21 to the concave arc surface of the CRS distribution plate 2, so as to form a fluidized separation space above the concave arc surface of the distribution plate 2 to make a single layer of discretized and homogenized CRSs; and allowing light flaky CRSs to be sucked into the suction port T2, and allowing remaining finished CRSs to fall to the guide plate 3 by gravity and to be discharged from the discharge port T3.

The method further includes: separating light flaky CRSs at an arbitrary separation ratio to obtain finished CRSs by adjusting the angle of the guide surface 112 relative to the horizontal plane, the rotation speed of the throwing roller 12, the angle of the tangent plane of the convex arc surface of the CRS distribution plate 2 relative to the horizontal plane and the suction speed of the suction fan T22.

The present disclosure has the following beneficial effects:

1. The device of the present disclosure utilizes the negative-pressure air of a CRS de-dusting duct to fully separate the finished CRSs from the light flaky CRSs. The device of the present disclosure is designed for the first time, and can be directly connected to a pneumatic CRS feeding and discharging section of a production line. The device of the present disclosure is compact and suitable for industrial production.

2. In the present disclosure, the concave arc surface 111 of the guide plate 11 of the guide device 1 is in contact with and adapted to the surface of the throwing roller 12. The guide surface 112 has an upper end provided under the feed port T1 and a lower end provided on the surface of the throwing roller 12. The angle of the guide surface 112 relative to the horizontal plane is adjustable, and the throwing roller 12 has an adjustable rotation speed. The design can prevent the CRSs from being lifted by the negative-pressure air at the bottom of the guide plate 11, ensuring that the CRSs all enter the concave arc surface of the CRS distribution plate, and preventing the CRSs from jamming and accumulating at the feed port. The final rectangular surface of the guide plate 11 may have an area the same as or different from that of the guide surface 112 as required, and the angle between the two surfaces of the guide plate may be designed as required.

3. In the present disclosure, the homogenizing baffles are axially evenly arranged on the surface of the throwing roller. The homogenizing baffles 121 are parallel with each other and each are bent at a midpoint, forming a swallow-wing pattern with a tip 1211 facing forward on the surface of the throwing roller 12. The throwing roller 12 rotates with the tip 1211 facing forward. In this way, the CRSs between the homogenizing baffles 121 are dispersed axially, and are thrown into the concave arc surface of the CRS distribution plate 2. In the present disclosure, the evenly distributed homogenizing baffles on the surface of the throwing roller are ingeniously conceived.

4. The CRS distribution plate of the device of the present disclosure is ingeniously designed with an open area of 5.0-20.0%. The concave arc surface of the CRS distribution plate faces the guide device. The air flows from under the CRS distribution plate to the concave arc surface of the CRS distribution plate through the evenly distributed air vents to form an evenly distributed air pressure. Meanwhile, the air forms a positive pressure on the concave arc surface, such that the CRSs thrown by the throwing roller are in flexible contact with the concave are surface of the CRS distribution plate. Thus, the light flaky CRSs are turned over to run upward, making the finished CRSs not easily broken.

5. In the present disclosure, the discharge port of the device is provided under the CRS distribution plate, and is the only air inlet of the closed separation bin. The air entering from the discharge port flows from under the CRS distribution plate through the evenly distributed air vents to the concave arc surface of the CRS distribution plate so as to form an evenly distributed air pressure on the concave arc surface. This further enables the CRSs thrown by the throwing roller to contact the concave arc surface flexibly, thereby making the CRSs not easily broken.

6. The use of the device of the present disclosure to separate CRSs has no influence on the smooth conveyance of materials on the production line, and ensures that the CRSs do not lose moisture during the processing. The present disclosure improves the whole cut rate, density, processing endurance and filling value of the finished CRSs obtained by separating the light flaky CRSs. In addition, the present disclosure makes the color of the finished CRSs closer to that of the cut laminas, and makes the finished CRSs blended with the cut laminas more uniformly, thereby significantly improving the use value of the CRSs.

7. The device of the present disclosure can be used to separate light flaky CRSs from CRSs. In addition, by adjusting the open area of the CRS distribution plate, the suction speed of the suction fan T22 and the rotation speed of the throwing roller, the device of the present disclosure can also be used to remove denser components of CRSs, such as slivers, wet mass and other debris. Therefore, the device of the present disclosure has multiple functions.

Figure 1:
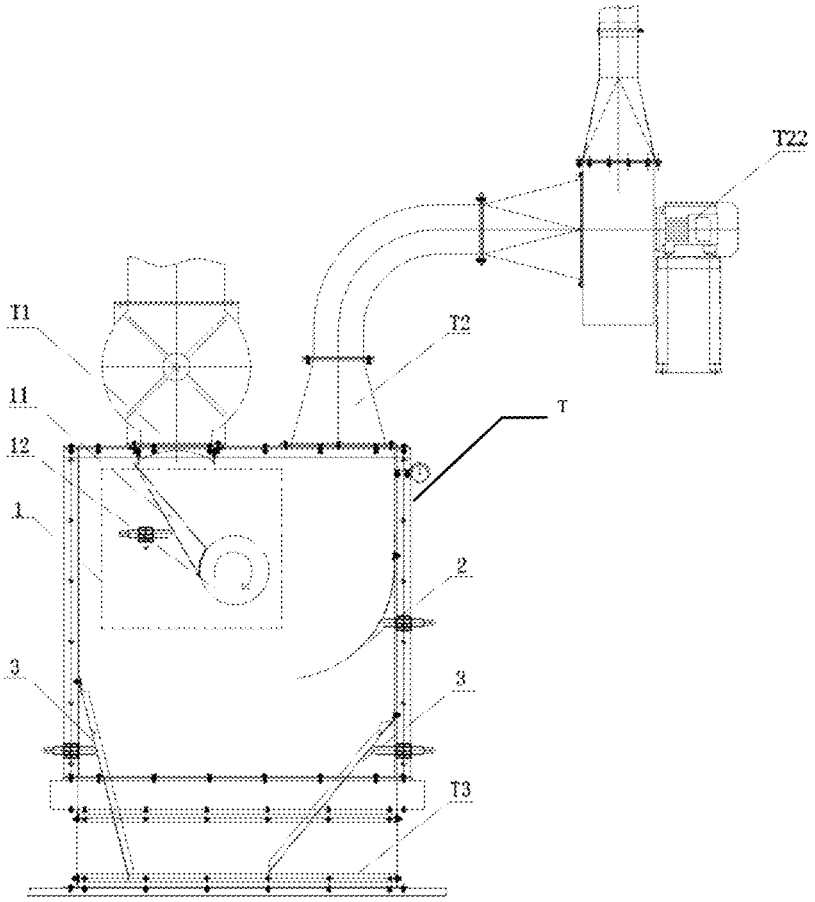
FIG. 1 is a schematic diagram of a device for separating light flaky CRSs by a throwing roller according to the present disclosure.

Reference Numerals: 1. guide device; 11. guide plate; 111. concave arc surface; 112. guide surface; 12. throwing roller; 121. homogenizing baffle; 1211. tip; 2. distribution plate; 21. air vent; 3. guide plate; T. separation bin; T1. feed port; T2. suction port; T22. suction fan; and T3. discharge port.

DETAILED DESCRIPTION OF THE EMBODIMENTS

In order to make the objectives, technical solutions and beneficial effects of the present disclosure clearer, the implementations of the present disclosure will be further described in detail under with reference to the drawings. The drawings and embodiments are not intended to limit the technical solutions of the present disclosure, and any variations and improvements made based on the teachings of the present disclosure all fall within the protection scope of the present disclosure.

As shown in FIG. 1, a device for separating light flaky CRSs by a throwing roller includes a vertically provided rectangular parallelepiped-shaped separation bin T, and a CRS guide device 1 and a CRS distribution plate 2 which are arranged in the separation bin T. The CRS guide device 1 includes a guide plate 11 and a throwing roller 12. A surface of the throwing roller 12 is axially evenly provided with multiple homogenizing baffles 121. The CRS distribution plate 2 is arc-shaped, and evenly provided with multiple air vents 21. A CRS feed port T1 is provided above the CRS guide device 1. The guide plate 11 is provided on an upper portion of the throwing roller 12 to guide CRSs fed through the feed port T1 to the surface of the throwing roller 12. A suction port T2 is provided above the CRS distribution plate 2, and is connected to an external suction fan T22. The CRS distribution plate 2 is provided under a side of the CRS guide device 1, with a concave arc surface facing the CRS guide device 1. A bottom portion of the separation bin T is provided with a guide plate 3. A discharge port T3 is provided at a bottom of the guide plate 3, and the discharge port T3 is located directly under the CRS distribution plate 2. The suction fan T22 connected to the suction port T2 has an adjustable suction speed.

Figure 2:
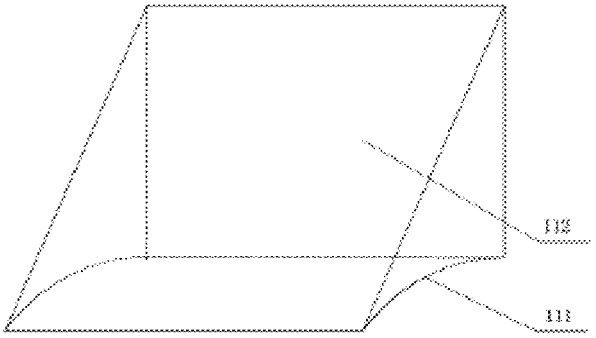
FIG. 2 is a schematic diagram of a guide plate according to the present disclosure.

As shown in FIG. 2, the guide plate 11 is in the shape of a triangular prism, with a rectangular concave arc surface 111 and a rectangular guide surface 112. The guide surface 112 has an upper end provided under the feed port T1 and a lower end provided on the surface of the throwing roller 12. The concave arc surface 111 of the guide plate 11 is adapted to the surface of the throwing roller 12. An angle of the guide surface 112 relative to a horizontal plane is adjustable. The throwing roller 12 has an adjustable rotation speed to prevent the CRSs from jamming and accumulating on the surface of the guide plate or the throwing roller. The guide plate 11 is formed by welding two rectangular straight plates and one concave arc plate with unequal areas, and it may be made of stainless steel 307. The concave arc surface 111 is in dynamic and close contact with the homogenizing baffles 121 of the throwing roller 12 to prevent the CRSs from being lifted by negative-pressure air at a bottom portion of the guide plate 11. The guide plate 11 may be pneumatically controlled.

Figure 3:
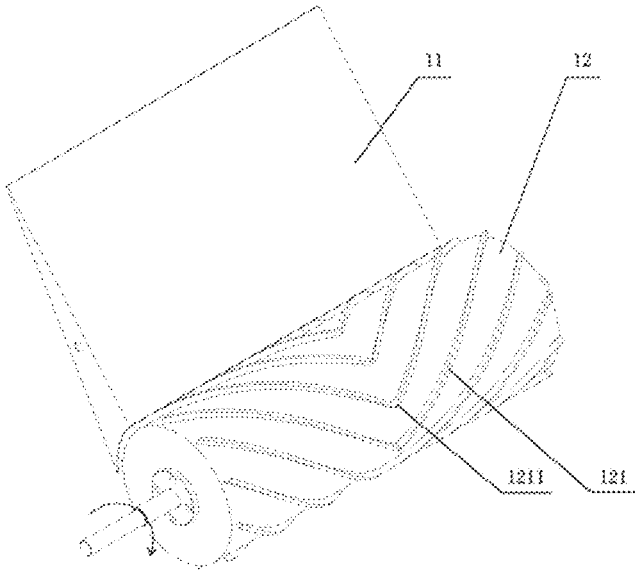
FIG. 3 is a schematic diagram of the guide plate integrated with a throwing roller rotating in a direction indicated by the arrow according to the present disclosure.

As shown in FIG. 3, the homogenizing baffles 121 are axially and evenly arranged on the surface of the throwing roller 12. The homogenizing baffles 121 are parallel with each other and each are bent at a midpoint, forming a swallow-wing pattern with a tip 1211 facing forward on the surface of the throwing roller 12. The throwing roller 12 rotates with the tip 1211 facing forward. The throwing roller 12 is composed of a steel shaft body and a stainless steel cylinder body. The homogenizing baffles 121 may be made of silica gel or polyethylene (PE), and may have a height of 2.5-50 mm as required. At this height, the CRSs can be evenly distributed on the surface of the throwing roller, and quickly and evenly thrown to a fluidized separation space above a concave arc surface of the CRSs distribution plate 2, so as to discretize and homogenize the CRSs in a single layer.

Figure 4:
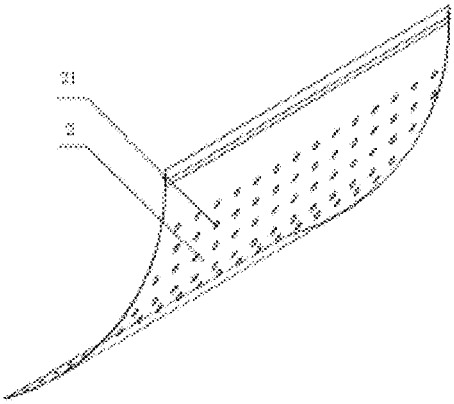
FIG. 4 is a schematic diagram of a distribution plate according to the present disclosure.

As shown in FIG. 4, an open area of the evenly distributed air vents of the CRS distribution plate 2 is 5.0-20.0%. Thus, the air flows from under the CRS distribution plate to the concave arc surface of the CRS distribution plate through the evenly distributed air vents 21 to form an evenly distributed air pressure. Meanwhile, the air forms a positive pressure on the concave arc surface, such that the CRSs thrown by the throwing roller 12 are in flexible contact with the concave arc surface of the CRS distribution plate 2. The light flaky CRSs are turned over to run upward making the finished CRSs not easily broken. An angle of a tangent plane of a convex arc surface of the CRS distribution plate 2 relative to a horizontal plane is adjustable. The CRS distribution plate 2 may be made of stainless steel 307.

Multiple access doors may be provided on a wall of the separation bin T to monitor the fluidization and discretization of the CRSs, check a pneumatic conveying device, and perform routine maintenance of components.

A method of separating light flaky CRSs uses the above-mentioned device and includes the following steps: turn on the suction fan T22, and adjust the suction speed of the suction fan, adjust the angle of the guide surface 112 relative to the horizontal plane to be 60°, and adjust the angle of the tangent plane of the convex arc surface of the CRS distribution plate 2 relative to the horizontal plane to be 60°; set the rotation speed of the throwing roller to 80 rpm, and set an opening of the suction fan T22 to 25%; allow CRSs fed through the feed port T1 to slide down the guide surface 112 by gravity and negative pressure air and rest between the homogenizing baffles 121 of the throwing roller 12, so as to evenly distribute the CRSs in an axial direction of the throwing roller; rotate the throwing roller 12 with the tip 1211 facing forward, such that the CRSs between the homogenizing baffles 121 are dispersed axially, and are thrown into the concave arc surface of the CRS distribution plate 2; form a negative pressure in the separation bin T by the suction fan T22, such that the air flows from under the CRS distribution plate 2 through the evenly distributed air vents 21 to the concave arc surface of the CRS distribution plate 2, so as to form a fluidized separation space above the concave arc surface of the distribution plate 2 to make a single layer of discretized and homogenized CRSs; and allow light flaky CRSs to be sucked into the suction port T2 by the negative pressure air, and allow remaining high-density finished CRSs to fall to the guide plate 3 by gravity and to be discharged from the discharge port T3, where the discharge port T3 may be connected to equipment on an original production line. The discharge port of the device is provided under the CRS distribution plate, and is the only air inlet of the closed separation bin. The air entering from the discharge port flows from under the CRS distribution plate 2 through the evenly distributed air vents to the concave arc surface of the CRS distribution plate so as to form an evenly distributed air pressure. This further enables the CRSs thrown by the throwing roller to contact the concave arc surface flexibly, thereby making the CRSs not easily broken.

Figure 5:
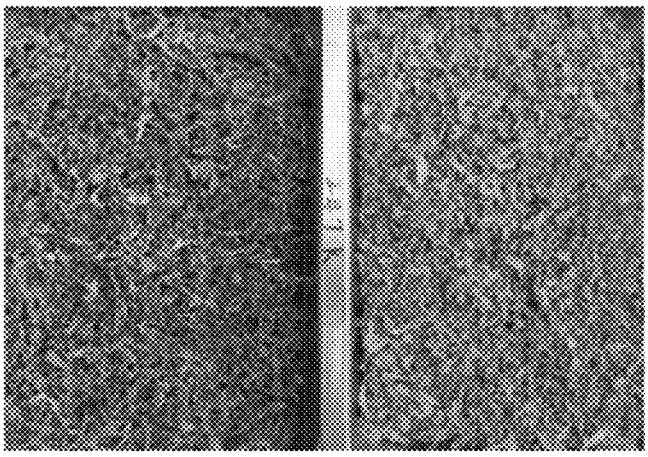
FIG. 5 shows a photo of light flaky CRSs (right) separated by the device of the present disclosure and finished CRSs (left) obtained according to an embodiment of the present disclosure.

The device of the present disclosure was used to separate light flaky CRSs. The separated light flaky CRSs were 177.8 kg/lot, and the finished CRSs were 1543.4 kg/lot. Therefore, the separated light flaky CRSs accounted for 177.8/(177.8+1543.4)=10.33% by weight of the incoming CRSs. The separation effect is indicated by a photo shown in FIG. 5.

The above described are merely specific implementations of the present disclosure, and the protection scope of the present disclosure is not limited thereto. Any modification or replacement easily conceived by those skilled in the art within the technical scope of the present disclosure should fall within the protection scope of the present disclosure. Therefore, the protection scope of the present disclosure should be subject to the protection scope of the claims.

What is claimed is:

1. A device for separating light flaky cut rolled stems (CRSs) by a throwing roller, comprising: a vertically provided separation bin, a CRS guide device, and a CRS distribution plate, wherein the CRS guide device and the CRS distribution plate are arranged in the vertically provided separation bin;

the CRS guide device comprises a guide plate and a throwing roller; the guide plate of the CRS guide device is in the shape of a triangular prism, the triangular prism having a first rectangular surface provided with an inwardly concave arc surface which receives an arcuate surface of the throwing roller provided on an upper portion of said throwing roller and a second rectangular surface provided adjacent said inwardly concave arc surface and formed as a guide surface; said guide surface being adjustable at an angle relative to a horizontal plane and the CRS distribution plate is arc-shaped and evenly provided with multiple air vents; and a CRS feed port is provided above the CRS guide device; the guide plate of the CRS guide device is provided on an upper portion of a side of the throwing roller, such that the guide surface guides CRSs fed through the CRS feed port to the arcuate surface of the throwing roller; a suction port is provided above the CRS distribution plate and is connected to an external suction fan; and the CRS distribution plate is provided under a side of the CRS guide device with a concave arc surface facing and positioned across from the CRS guide device and the throwing roller on an opposing wall of said vertically provided separation bin.

2. The device for separating the light flaky CRSs by the throwing roller according to claim 1, wherein the inwardly concave arc surface is adapted to receive the arcuate surface of the throwing roller in a complementary manner; and the guide surface has an upper end provided under the CRS feed port and a lower end provided adjacent the arcuate surface of the throwing roller.

3. The device for separating the light flaky CRSs by the throwing roller according to claim 1, wherein the arcuate surface of the throwing roller is axially evenly provided with multiple homogenizing baffles; and the multiple homogenizing baffles on the arcuate surface of the throwing roller are parallel to each other, and each of the multiple homogenizing baffles is bent at a midpoint, forming a swallow-wing pattern with a tip facing forward on the arcuate surface of the throwing roller.

4. The device for separating the light flaky CRSs by the throwing roller according to claim 3, wherein the throwing roller rotates in a direction of the tip facing forward; and the throwing roller has an adjustable rotation speed.

5. The device for separating the light flaky CRSs by the throwing roller according to claim 1, wherein the CRS distribution plate has an open area of 5.0-20.0%.

6. The device for separating the light flaky CRSs by the throwing roller according to claim 5, wherein an angle of a tangent plane of a convex arc surface of the CRS distribution plate relative to a horizontal plane is adjustable.

7. The device for separating the light flaky CRSs by the throwing roller according to claim 1, wherein a bottom portion of the vertically provided separation bin is provided with a guide plate; a discharge port is provided at a bottom of the guide plate at the bottom portion of the vertically provided separation bin; and the discharge port is also located under the CRS distribution plate.

8. The device for separating the light flaky CRSs by the throwing roller according to claim 1, wherein the external suction fan has an adjustable suction speed.

9. The device for separating the light flaky CRSs by the throwing roller according to claim 1, wherein the vertically provided separation bin is in a shape of a rectangular parallelepiped.

10. A method for separating the light flaky CRSs using the device according to claim 1 and comprising the following steps: turning on the external suction fan and adjusting a suction speed of the external suction fan; allowing the CRSs fed through the CRS feed port to slide down the guide surface and rest between multiple homogenizing baffles provided on the throwing roller; rotating the throwing roller in a forward direction indicated by a tip provided on each of the multiple homogenizing baffles facing forward, such that the CRSs between the multiple homogenizing baffles are dispersed axially and are thrown into the concave arc surface of the CRS distribution plate; forming a negative pressure in the vertically provided separation bin by the external suction fan, such that air flows from under the CRS distribution plate through the multiple air vents to the concave arc surface of the CRS distribution plate to form a single layer of discretized CRSs above the concave arc surface of the CRS distribution plate for fluidized separation; and allowing the light flaky CRSs to be sucked into the suction port, and allowing remaining finished CRSs to fall down to a guide plate provided at a bottom portion of the vertically provided separation bin by gravity and to be discharged from a discharge port; and separating the light flaky CRSs at an arbitrary separation ratio to obtain finished CRSs by adjusting the angle of the guide surface relative to the horizontal plane, a rotation speed of the throwing roller, an angle of a tangent plane of the convex arc surface of the CRS distribution plate relative to the horizontal plane, and a suction volume of the external suction fan.

11. The method for separating the light flaky CRSs according to claim 10, wherein in the device, the inwardly concave arc surface is adapted to receive the arcuate surface of the throwing roller in a complementary manner; and the guide surface has an upper end provided under the CRS feed port and a lower end provided adjacent the arcuate surface of the throwing roller.

12. The method for separating the light flaky CRSs according to claim 11, wherein in the device, the throwing roller has an adjustable rotation speed.

13. The method for separating the light flaky CRSs according to claim 10, wherein in the device, the arcuate surface of the throwing roller is axially evenly provided with the multiple homogenizing baffles; and the multiple homogenizing baffles on the arcuate surface of the throwing roller are parallel to each other, and each of the multiple homogenizing baffles is bent at a midpoint, forming a swallow-wing pattern with the tip of each of the multiple homogenizing baffles facing forward on the arcuate surface of the throwing roller.

14. The method for separating the light flaky CRSs according to claim 10, wherein in the device, the CRS distribution plate has an open area of 5.0-20.0%.

15. The method for separating the light flaky CRSs according to claim 14, wherein in the device, the angle of the tangent plane of the convex arc surface of the CRS distribution plate relative to the horizontal plane is adjustable.

16. The method for separating the light flaky CRSs according to claim 10, wherein in the device, a bottom portion of the vertically provided separation bin is provided with the guide plate at the bottom portion of the vertically provided separation bin; the discharge port is provided at a bottom of the guide plate at the bottom portion of the vertically provided separation bin; and the discharge port is also located under the CRS distribution plate.

17. The method for separating the light flaky CRSs according to claim 10, wherein in the device, the external suction fan has an adjustable suction speed.

18. The method for separating the light flaky CRSs according to claim 10, wherein in the device, the vertically provided separation bin is in a shape of a rectangular parallelepiped.

* * * * *